US007762908B2

(12) United States Patent
Perkins

(10) Patent No.: US 7,762,908 B2
(45) Date of Patent: Jul. 27, 2010

(54) $AL_2O_3$ MATERIAL USED IN A GOLF CLUB HEAD

(76) Inventor: Russell W. Perkins, 13179 Hazelwood Dr., Carmel, IN (US) 46033

( * ) Notice: Subject to any disclaimer, the term of this patent is extended or adjusted under 35 U.S.C. 154(b) by 44 days.

(21) Appl. No.: 11/619,818

(22) Filed: Jan. 4, 2007

(65) Prior Publication Data

US 2007/0161432 A1 Jul. 12, 2007

Related U.S. Application Data

(60) Provisional application No. 60/756,751, filed on Jan. 6, 2006.

(51) Int. Cl.
*A63B 53/04* (2006.01)

(52) U.S. Cl. ..... 473/340; 473/342

(58) Field of Classification Search ..... 473/324–350
See application file for complete search history.

(56) References Cited

U.S. PATENT DOCUMENTS 3,975,023 A 8/1976 Inamori
4,768,787 A 9/1988 Shira
5,547,427 A 8/1996 Rigal et al.
5,804,522 A * 9/1998 Uegami ..... 501/127
6,273,832 B1 * 8/2001 Helmstetter et al. ..... 473/324
7,278,926 B2 * 10/2007 Frame ..... 473/329
2002/0091014 A1 * 7/2002 Aldrich ..... 473/324
2005/0130764 A1 * 6/2005 Frame ..... 473/340
2006/0009306 A1 * 1/2006 Bauer et al. ..... 473/324

FOREIGN PATENT DOCUMENTS

JP 2003236022 A * 8/2003

* cited by examiner

*Primary Examiner*—Alvin A Hunter
(74) *Attorney, Agent, or Firm*—Woodard, Emhardt, Moriarty, McNett & Henry LLP

(57) ABSTRACT

Golf club heads having an $Al_2O_3$ material impact surface are described. All or a portion of the head may be made of an $Al_2O_3$ material, or the $Al_2O_3$ material may be in the form of a sheet or insert and applied to a golf club face. Embodiments of this disclosure have an enhanced coefficient of restitution value in the context of collision with a golf ball.

4 Claims, 3 Drawing Sheets

$AL_2O_3$ MATERIAL USED IN A GOLF CLUB HEAD

CROSS REFERENCE TO RELATED APPLICATIONS

This application claims the benefit of Provisional Application Ser. No. 60/756,751 filed Jan. 6, 2006.

BACKGROUND

Embodiments of this invention relate to a golf club head. More particularly, embodiments are directed to a golf club head having at least an impact surface made of $Al_2O_3$ material.

Golf clubs heads have generally been made from wood, steel, carbon, titanium, polymers or alloys of these. They may be forged, pressed, injection molded or otherwise created. Golf club heads, including inserts and coatings, are disclosed in U.S. Pat. Nos. 5,029,865; 5,620,382 and 6,723,007; and U.S. patent application Ser. No. 11/143,247

$Al_2O_3$ material is known commercially by many names and forms. Single crystal forms are known generally as corundum and popularly as ruby and sapphire. The amorphous form, generally known as ceramic, is more easily obtained (and thus less expensive) and exhibits similar characteristics as the single crystal form. $Al_2O_3$ material in the single crystal form is called sapphire or ruby; it is the 2nd hardest substance on the Mohs hardness scale, ranking 9 out of 10-10 being diamond. Because of the extreme hardness and other features of the material, it imparts desirable characteristics to the impact surface for golf club heads. The best impact that one can achieve is a perfectly elastic collision where all energy is transferred from one object (the golf club) to another object (the golf ball). In practical applications, deformation of each object's material results in some loss of energy. By using superior materials for the impact surface of the golf club, the energy loss due to deformation of the collision can be minimized and provide the player with enhanced control, distance, and feel.

As golf players desire to increase the distance golf balls are hit, there is a need for golf ball clubs that allow maximization of that distance while offering control with minimal effort.

SUMMARY OF THE INVENTION

Disclosed are golf club heads including a shaft attaching portion and a ball impact surface composed of $Al_2O_3$ material having a coefficient of restitution value of at least 0.88 when a golf ball impacts the surface. Also disclosed is a method of optimizing the distance for hitting a golf ball which entails use of the above golf club heads in conjunction with a high compression golf ball. Additionally disclosed is a method of manufacturing a golf club head of the present disclosure where the golf club head has a pocket sized and shaped to accommodate an $Al_2O_3$ material provided in a sheet, strip or other insert form, and this material is attached to the pocket in the head.

DETAILED DESCRIPTION OF THE PREFERRED EMBODIMENTS $Al_2O_3$ material includes single crystal, amorphous (or ceramic), clear, doped (e.g. colored with traces of other elements or compounds) or otherwise colored, opaque, clear or slightly impure aluminum oxide. Single crystal $Al_2O_3$ material (common name sapphire, or, in the case of red, ruby) is generally translucent and comes in a variety of colors. Amorphous, or ceramic, $Al_2O_3$ material is generally opaque and can also come in a variety of colors. The coloring of $Al_2O_3$ material, whether single crystal or amorphous, is generally derived from trace chemical doping and is well documented in references. Because of chemical doping, $Al_2O_3$ material can be a varied array of desirable colors, such as red, blue, green, orange, pink, purple, yellow or other colors. Single crystal $Al_2O_3$ material can be naturally occurring (mined) or synthetically created. Amorphous $Al_2O_3$ material is generally synthetically prepared. Single crystal $Al_2O_3$ material, e.g. sapphire and ruby, are precious gems and there is inherent value in the naturally occurring versions. The synthetic versions of these offer purity not found in nature, as well as the ability to create larger sizes than are readily available in nature at a reasonable cost. The most common techniques for growing sapphire crystal are the Verneuil, Hydrothermal, and Czochralski. For manufacturing techniques to synthesize sapphire, refer to ISBN: 0-8019-6773-2 Nassau, Kurt. *Gems Made by Man*, and ISBN: 0-8155-0788-7 Yaverbaum, Lee *Synthetic gems, production techniques.*

Figure 1:
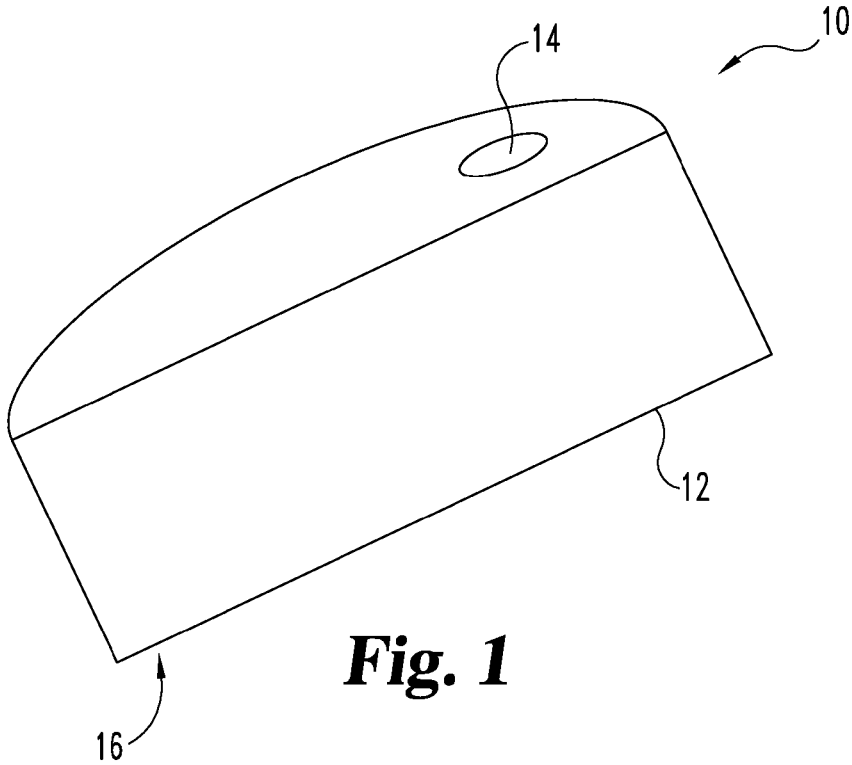
FIG. 1 is a front perspective view of the preferred embodiment of this disclosure using $Al_2O_3$ material for the entire golf club head.

In embodiments presently disclosed, $Al_2O_3$ material is used to make golf club heads—putters, irons, woods or other golf club heads. The embodiments disclosed herein address golf club heads made from $Al_2O_3$ material, either wholly or in part. The $Al_2O_3$ material may be used for the entire golf club head, a portion of it, or processed into thin sheets and applied to the impact surface of a golf club head. As shown in FIG. 1, head 10 may include at least one ball impact surface 12 and a shaft attaching portion 14 (customarily referred to as a hosel). Any portion of golf club head 10 may be made from $Al_2O_3$ material, including all of it, but the ball impact surface 12 must be made from an $Al_2O_3$ material, which is at least sheet-thickness (approximately >1 mm) in order to achieve the attributed performance enhancing characteristics embodied in this disclosure.

As illustrated in FIG. 1, golf club head 10 is generally hemi-cylindrical and has a generic "putter" shape. However, this illustration is not intended to limit club head 10 to any particular size, type, shape or configuration, as head 10 may be sized and/or configured in numerous ways. As a non-limiting example, head 10 may have a cavity or cavities added to impart differential weight distribution (e.g. "perimeter weighting") or they may have a chamfered back, or other features. Additionally, the present disclosure is not intended to be limited to putters, but rather to apply to all types of golf clubs, including woods, hybrids, irons, putters, wedges and novelty configured clubs.

In the illustrated embodiment, head 10 has one impact surface 12, which is flat, smooth and generally occupies the face 16 of head 10. While most regulation golf clubs have only one impact surface (with an exception being made for putters, which may have two), non-conforming configurations of heads having additional impact surfaces are contemplated. Likewise, although not customary, this disclosure would cover impact surfaces which were other than smooth and flat, such as those which are concave, convex, textured, rough, unpolished or occupy substantially less than most of face 16. Shaft attaching portion 14 is depicted as a hole (commonly referred to as a hosel), which may or may not be threaded and may be permanently attachable or removably attachable. Again, although this is the customary means for attaching a shaft to head 10, non-conventional and non-conforming attaching head portions are contemplated and are intended to fall within this disclosure.

The present disclosure provides heads which have a greatly enhanced coefficient of restitution (COR), a measure of the percentage of energy transferred in a collision. In very simple terms, COR is a measure of the energy lost in the collision. A COR of 1 indicates a perfectly elastic collision with no loss, and a COR of 0 is an inelastic collision. All collisions with large bodies (such as ball and club) are inelastic to some extent, with a COR value of less than 1. For further explanation of elastic collisions, a college physics textbook or the following hyperphysics website: http://hyperphysics.phy-astr.gsu.edu/hbase/hframe.html may be consulted. There is a trend towards the use of high compression ("harder") golf balls to allow increased energy to be transferred from the club to the ball, thereby resulting in a golf shot with greater distance. Compression is necessary for the golf ball to achieve its maximum distance when hit. Club head speed or the inelasticity of the collision may be increased to maximize compression and thereby maximize shot distance.

The use of $Al_2O_3$ material as an impact surface increases the inelasticity of the ball's collision with the club head while enabling adequate compression of the ball. This ensures that long distance shots are made with minimal effort and maximal control. Embodiments of this disclosure have COR values of at least 0.88 (when used with softer, low compression balls) and at least 0.91 (when used with high compression balls). The COR values may vary within this range, for example, embodiments of this disclosure may have COR values of 0.89, 0.90, 0.91, or beyond 0.91. The COR values when used with a lower compression ball are at or above the values of other commercial golf clubs heads currently available; when used with a high compression ball, the COR values are statistically higher than those for a variety of commercial golf club heads.

In embodiments of the present disclosure, ball impact surface is composed of $Al_2O_3$ material, present as either a sheet or strip or as portion of a larger piece. FIG. 1 illustrates a head 10 made in its entirety of single crystal $Al_2O_3$ material. While expensive to produce, this embodiment has high aesthetic value in addition to its enhanced performance features. In other embodiments of the present disclosure, portions of the head use $Al_2O_3$ material. For example, a less expensive and lighter product which retains the performance characteristics of head 10 (made in its entirety of single crystal $Al_2O_3$ material) can be made using $Al_2O_3$ material in the amorphous, ceramic form. This form is opaque, but can be doped to provide color just as the single crystal form.

Figure 2:
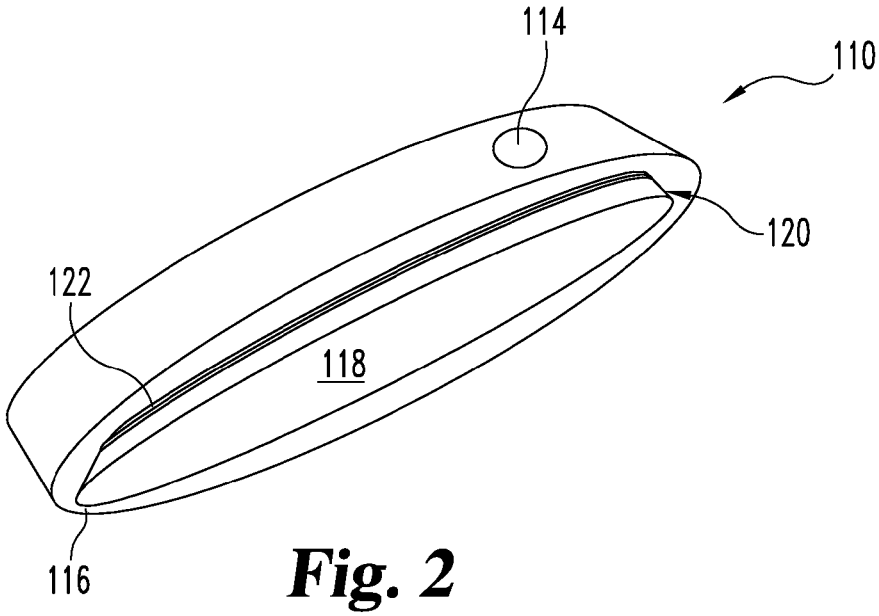
FIG. 2 is a front perspective view of the alternate embodiment of this disclosure using a sheet of $Al_2O_3$ material in a pocket of a pre-existing golf club head.

As shown in FIG. 2, synthesis techniques for $Al_2O_3$ material also allow for sheets or inserts 118 of material to be readily made at various thicknesses. In this embodiment, sheets 118 may be applied mechanically to impact surface or face 116 of the golf club in numerous ways allowing head 110 to minimize its weight (and also decrease its price), yet retain the impact surface properties of the $Al_2O_3$ material. Sheet 118 may be adhered using epoxy or glue. Many epoxies are commercially available that are suitable for attaching $Al_2O_3$ material to club head face 116. One, non-limiting example of this is the Clubmaker brand #9312 shafting epoxy. Utilizing epoxy to attach the $Al_2O_3$ material to face 116 allows for direct adherence of $Al_2O_3$ material to face 116. Alternatively, a pocket or recessed area 120 may be provided for affixing sheet 118, which may further secure sheet 118 to face 116. The $Al_2O_3$ material may be adhered (via glue, epoxy or other means) or placed into pocket 120 using an interference fit. For example, a pocket 120 could be similar in shape to sheet 118, but undersized (relative to sheet 118) by a few thousands of an inch to create an interference fit. A golf club head may have an interference fit that is a press fit with a pocket that is undersized by up to 0.003 of an inch. Then a mechanical or a hydraulic press could be used to combine the two components with a large force. In some embodiments, the press fit pocket may be enhanced by an under cut so that a small rib 122, tab or other securing means on the edge of $Al_2O_3$ material insert 118 may allow a snap fit into pocket 120.

Golf club heads embodied in the present disclosure are not limited to any particular type of golf club. For example, many, if not all, varieties golf club shafts may be used in conjunction with the present disclosure. Additionally, a wide variety of hosels or attaching portions are contemplated and would fall within the spirit of this disclosure. For example, the hosel may be in the form of a threaded hole, allowing the head to screw on, or the head may be more permanently attached to the shaft through the use of an epoxy or other adhesive. Though not conventional, the shaft may be attached to the head in other ways, and this disclosure should not be limited by the method or form of attachment of the golf club head. Furthermore, numerous means of manufacture for a golf club having a head embodied in this disclosure are contemplated. Heads may be assembled as part of a complete golf club assembly, may be manufactured as a separate component; they may be custom made, retro fitted or factory made. The embodiments described above may be used in conjunction with or as a replacement for any conforming golf club heads. Additionally, the embodiments may also be used for a non-conforming club head design if desired.

Example 1

A sapphire club head was made from a solid sapphire disk (single crystal $Al_2O_3$) approximately 1 inch thick and 3.4 inches in diameter. The disk was cut in half to produce a hemispherical body which was then shaped, filed and tumbled. FIG. 1 depicts the general characteristics of this prototype.

Example 2

Evaluation of seven types of golf balls and four golf club heads, including the prototype sapphire head was undertaken.

Example 3

Figure 3:
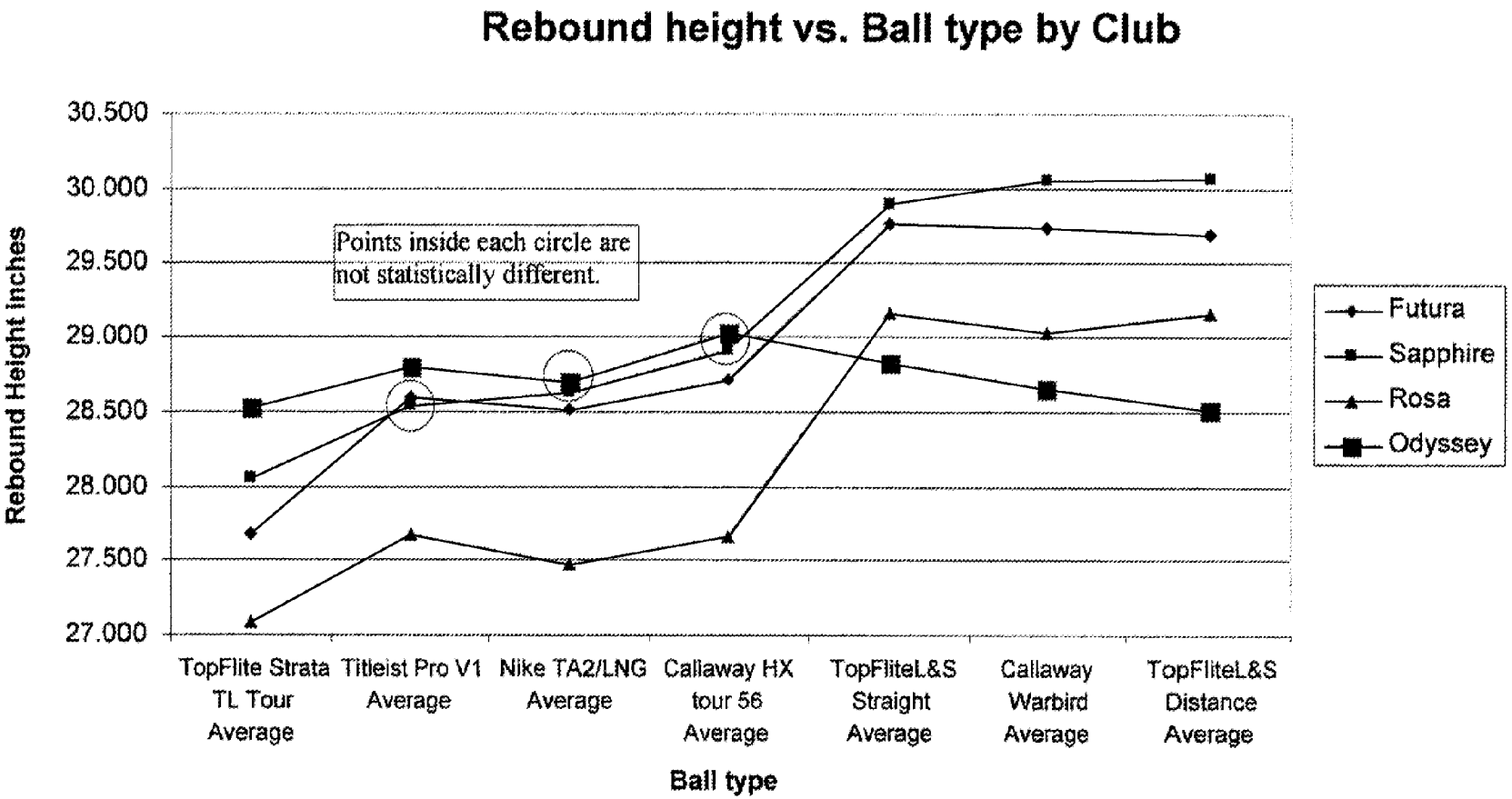
FIG. 3 is a graph demonstrating the rebound height versus the ball type by club.

Using the initial drop height, in this case 36 inches, and the experimentally-determined rebound height, the Coefficient of Restitution (COR) was calculated. In this experiment, the velocities were directly proportional to the rebound height and initial drop height such that the COR is equal to the square root of the rebound height divided by the initial drop height. The average rebound height was calculated for each ball type by club type (see FIG. 3). Each point on the graph represents the average of 30 measurements.

Example 4

Figure 4:
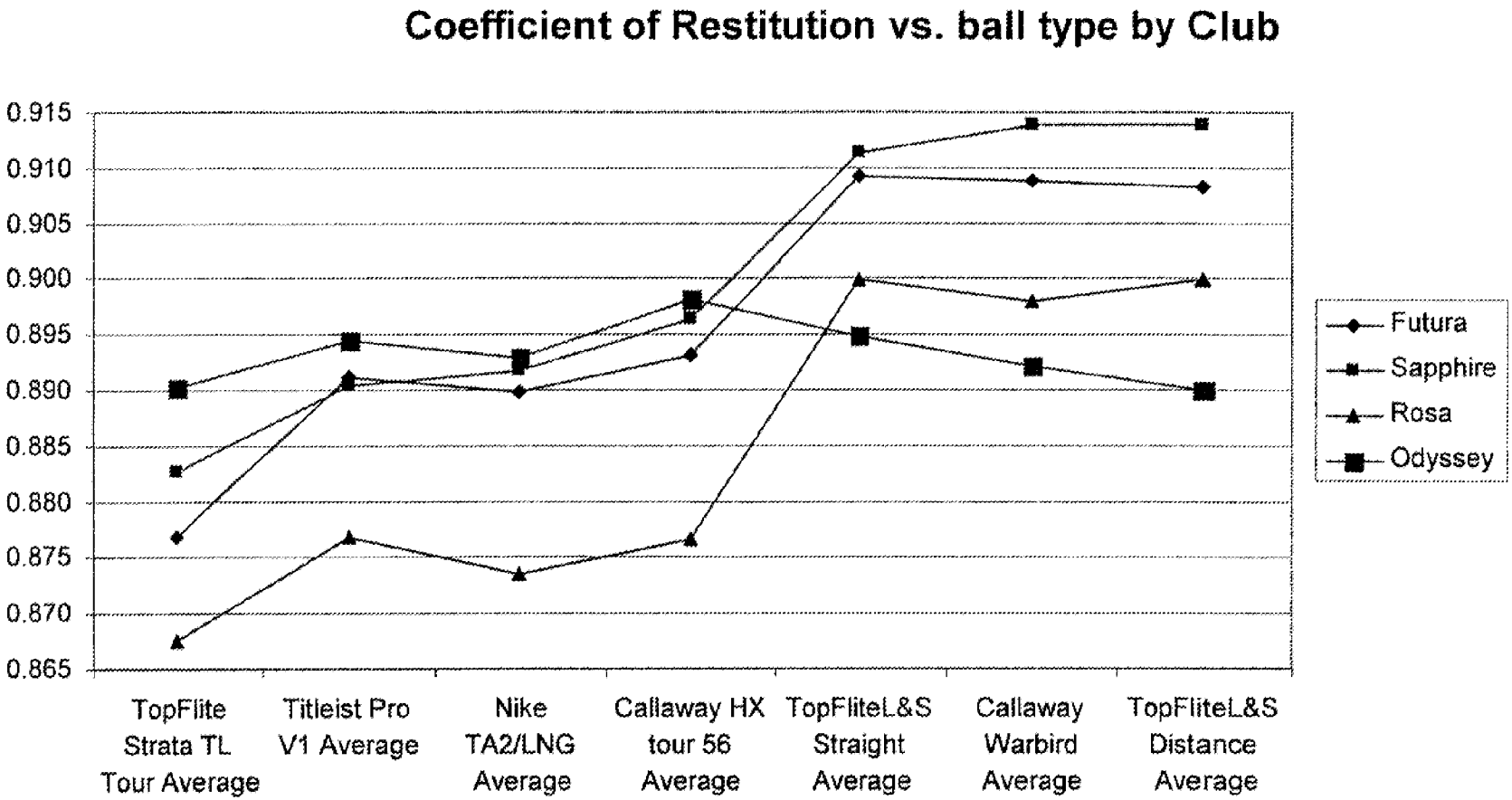
FIG. 4 is a graph demonstrating the coefficient of restitution versus the ball type by club.

The COR for each ball type by club was calculated (see FIG. 4).

A table of the data is presented below.

| | Rebound height | | | | COR | | | |
|---|---|---|---|---|---|---|---|---|
| brand | Futura | Sapphire | Rosa | Odyssey | Futura | Sapphire | Rosa | Odyssey |
| TopFlite Strata TL Tour Avg. | 27.679 | 28.046 | 27.092 | 28.533 | 0.877 | 0.883 | 0.867 | 0.890 |
| Titleist Pro V1 Average | 28.596 | 28.542 | 27.675 | 28.800 | 0.891 | 0.890 | 0.877 | 0.894 |
| Nike TA2/LNG Average | 28.507 | 28.629 | 27.475 | 28.704 | 0.890 | 0.892 | 0.874 | 0.893 |
| Callaway HX tour 56 Average | 28.717 | 28.921 | 27.667 | 29.033 | 0.893 | 0.896 | 0.877 | 0.898 |
| TopFliteL&S Straight Average | 29.758 | 29.892 | 29.154 | 28.825 | 0.909 | 0.911 | 0.900 | 0.895 |
| Callaway Warbird Average | 29.738 | 30.058 | 29.025 | 28.658 | 0.909 | 0.914 | 0.898 | 0.892 |
| TopFliteL&S Distance Average | 29.696 | 30.063 | 29.158 | 28.517 | 0.908 | 0.914 | 0.900 | 0.890 |

The types of golf balls used were:

1. TopFlite Strata TL Tour
2. Titleist Pro V1
3. Nike TA2/LNG
4. Callaway HX tour 56
5. TopFliteL&S Straight
6. Callaway Warbird
7. TopFliteL&S Distance The commercial clubs and prototype used were:

1. Scotty Cameron Futura putter by Titleist (milled carbon steel impact surface)
2. Rosa Monza Corza putter by Taylor Made (Titallium alloy impact surface)
3. Odyssey 2-Ball White Hot putter (urethane blend impact surface)

Sapphire prototype, made from single crystal $Al_2O_3$ material provided by Boule No. H424 Crystal Systems, Inc.

Three balls each of the seven ball types were dropped and impacted the four club heads. Ten replicates of each experiment were conducted. The balls were all dropped from a vertical height of 36 inches above the impact surface of each of the four club types tested. Each club was mounted with the impact surface orthogonal to the vertical path of the ball. The rebound height of each ball was recorded and the data analyzed.

In the high compression ball category (the TopFliteL&S Straight, Callaway Warbird, TopFliteL&S Distance) the sapphire outperformed all other clubs tested. In the medium compression category (Titleist Pro V1, Nike TA2/LNG, Callaway HX tour 56) the sapphire performed better than or statistically equivalent to the other clubs. In the low compression category (TopFlite Strata TL Tour) the sapphire was second only to the Odyssey, a club having a urethane blend impact surface. By combining the sapphire golf club with a harder ball, appropriate compression occurs and superior COR values (<91%) are achieved.

The raw data by ball type for each of the four clubs tested, statistical tests for variance and appropriate t-test for the means are provided in Appendix A of Provisional Application Ser. No. 60/756,751, herein incorporated by reference. The statistical data compares the sapphire prototype club to all other clubs used in the experiment.

I claim the following:

1. A golf club head comprising:

at least one ball impact surface and a shaft attaching portion, said ball impact surface composed of only single crystal sapphire $Al_2O_3$ material that is smooth having a coefficient of restitution value of at least 0.88 when a golf ball impacts said surface; and wherein a substantial portion, including said ball impact surface, of said head is composed of $Al_2O_3$ material.

2. A golf club head comprising:

at least one ball impact surface and a shaft attaching portion, said ball impact surface composed of only single crystal sapphire $Al_2O_3$ material that is smooth having a coefficient of restitution value of at least 0.88 when a golf ball impacts said surface, and wherein said head in its entirety is composed of single crystal sapphire $Al_2O_3$ material.

3. A golf club head comprising:

at least one ball impact surface and a shaft attaching portion, said ball impact surface composed of only single crystal sapphire $Al_2O_3$ material that is smooth having a coefficient of restitution value of at least 0.88 when a golf ball impacts said surface and wherein:

said $Al_2O_3$ material is provided in the form of a sheet of $Al_2O_3$ material; said sheet is attached using an interference fit; and said interference fit is a press fit wherein said pocket is undersized by up to 0.003 of an inch.

4. The golf club head of claim 3 wherein said press fit is further modified to allow for a snap fit with said pocket.

* * * * *